United States Patent [19]

Stegherr

[11] Patent Number: 4,632,165

[45] Date of Patent: Dec. 30, 1986

[54] METHOD AND APPARATUS FOR MILLING AND GROOVING WOODEN FRAMING MEMBERS ESP. HALVING JOINTS

[76] Inventor: Ludolf Stegherr, Donaustauger Strasse 30, 8400 Regensburg, Fed. Rep. of Germany

[21] Appl. No.: 751,532

[22] Filed: Jul. 3, 1985

[30] Foreign Application Priority Data

Jul. 5, 1984 [DE] Fed. Rep. of Germany ..... 3424680

[51] Int. Cl.[4] ..... B27M 1/00

[52] U.S. Cl. ..... 144/371; 144/3 R; 144/48; 144/122; 144/124; 144/136 R; 144/154; 144/368

[58] Field of Search ..... 144/1 B, 1 H, 3 R, 3 F, 144/48, 121, 122, 124, 127 R, 133 R, 133 A, 367, 368, 371, 136 R, 154

[56] References Cited

U.S. PATENT DOCUMENTS 1,200,836 10/1916 Hendrich ..... 144/48

*Primary Examiner*—W. D. Bray

*Attorney, Agent, or Firm*—Charles W. Fallow; Martin P. Hoffman; Mitchell B. Wasson

[57] ABSTRACT

A method and an apparatus are disclosed for cutting pairs of symmetrical bevels on opposite sides of halving joints used for windows, doors, and the like, and a groove-like recess on a third side of the workpiece. The first pair of bevels is cut on one side of the clamped workpiece by moving the cutting tool in a horizontal direction over and across the workpiece; then, the workpiece fastened within the clamping device is turned 180° over the operation path of the grooving tool, which cuts the recess automatically during this turning operation. Subsequently, the tool is moved in the opposite direction into the starting position as it cuts the pair of bevels into the second, opposite side of the workpiece, and finally the workpiece is turned back into the starting position.

9 Claims, 5 Drawing Figures

METHOD AND APPARATUS FOR MILLING AND GROOVING WOODEN FRAMING MEMBERS ESP. HALVING JOINTS

BACKGROUND OF THE INVENTION

1. Field of the Invention

The invention pertains to a method and an apparatus for milling or cutting pairs of bevels arranged symmetrically about the longitudinal axis of halving joints or similar members for windows, glass doors, and the like, as well as a groove-like recess lying between two pairs of bevels on opposite sides of the workpiece.

2. Description of the Prior Art

For milling or cutting bevels symmetrically about the center axis of halving joints, automatically operated milling machines of high efficiency are known. Such machines operate with one cutting unit per pair of bevels, so that the two pairs of bevels to be machined on opposite sides of the halving joint are milled simultaneously. This requires two separate milling units, which are independent from each other, one of which is arranged above the workpiece and the other below the workpiece. The cost of this type of automatic machine is rather high, so it can only be used economically if high production is required. However, for smaller firms, or if limited output rates will be sufficient, or if production is on an occasional basis, the high cost of such a machine is not justified.

For these lower production types of use, the cutting of bevels on halving joints for wooden frame portions and of grooves at the connections of the halving joints is ordinarily made in such a manner that at first, a bevel is cut into the workpiece while it is fastened on a clamping device; then the workpiece is released, turned 180°, fastened again, and the opposite bevel is milled. Subsequently thereto, the workpiece is released and fastened once more for the grooving operation. Repeated fastening and releasing of the workpiece causes considerable inaccuracies in operation, because the workpiece, after having been released, turned and refastened, is no longer in its original position, so that the two bevels may not be milled exactly symmetrically to the halving joint axis and thus, the required exact fit will be lost. Such inaccuracies can be reduced only by releasing and refastening the workpiece in a very careful manner, which requires considerable time, care and skill on the part of the operator.

SUMMARY OF THE INVENTION

Accordingly, it is an object of this invention to provide a method and an apparatus for cutting bevels and grooves on halving joints or similar workpieces for windows, glass doors, and the like, by means of a single cutting unit from two opposite sides, and simultaneously cutting a groove-like recess between two correlated bevels in an economical manner, without the necessity of releasing or repositioning the workpiece.

Furthermore, it is an object of this invention to cut the two bevels and the recess between them in one operation cycle.

The inventor proposes to fasten the workpiece to be cut by a clamping device, to cut the first bevel into the workpiece from one side by moving the cutting tool in one direction horizontally over and across the workpiece, to turn the workpiece attached to the clamping device over 180° around the longitudinal axis of the workpiece, to cut automatically the groove-like recess between the two bevels as the workpiece is turned in this manner across the operation path of the grooving tool, to return the cutting tool in the opposite direction into the starting position and simultaneously cut the second bevel into the other side of the workpiece, and subsequent thereto, to turn the workpiece into the starting position and to release the workpiece.

This method is performed by means of an apparatus having guiding means connected to the frame for carrying a cutting unit, which is movable horizontally across the apparatus, and is adjustable in height for cutting the bevels, workpiece-clamping means attached to the frame holding the workpiece under pressure, said workpiece being positionable within the clamping means relative to the tools and being pivotable over 180° around its longitudinal axis in such a manner that in both turning positions the upper edge of the workpiece has the same height level as the cutting tool, and by clamping means fastened to the frame for positioning a driven grooving tool arranged below the workpiece in such a manner that the grooving tool when being turned engages the workpiece in order to cut the recess between the two correlated bevels.

With the method and apparatus according to this invention, the two opposite, correlated bevels and the groove-like recess between the two bevels can be cut in one cycle without releasing and repositioning the workpiece by moving the cutting tool relative to the workpiece. The operation includes a forward and a backward movement; at the end of the forward movement, the workpiece is turned, together with the clamping means, 180° around the longitudinal axis of the workpiece so that the bevels cut during the forward movement are identical with the bevels cut during the backward movement of the tool at the opposite side of the workpiece.

The cutting unit is adjustable in height in order to be able to cut bevels of different depth or alternatively workpieces of different thicknesses. This adjustment in height preferably is done manually by adjusting a screw spindle; however, it can also be made in other known ways. Preferably, in addition, locking means are provided, which allow one to fasten the cutting unit at the selected height adjustment. Furthermore, the cutting tool is movable horizontally, transverse to the workpiece. The grooving tool is adjustable in height, as well as in a lateral direction, the latter in order to be able to provide for lateral corrections, which result from dimensional differences between the grooving tool and the cutting tool, for example, as caused by sharpening the tools.

Furthermore, this invention proposes to provide a positive dependency of the correction between the cutting tool and the grooving tool so that during operation, any existing inaccuracies between the cutting tool and the grooving tool may be automatically corrected.

The method and apparatus according to this invention results in an extremely simple and useful solution for cutting of correlated bevels of opposite pairs of sides of halving joints, and for grooving the recess between these bevels with minimum expenditure. Because grooving the recess is made in one cycle between cutting the first and the second bevels, the time for a cycle with this type of apparatus is very short, so that altogether, this apparatus is of considerable use and high efficiency for small firms or alternatively for small outputs of workpieces.

DESCRIPTION OF THE PREFERRED EMBODIMENT

Figure 1:
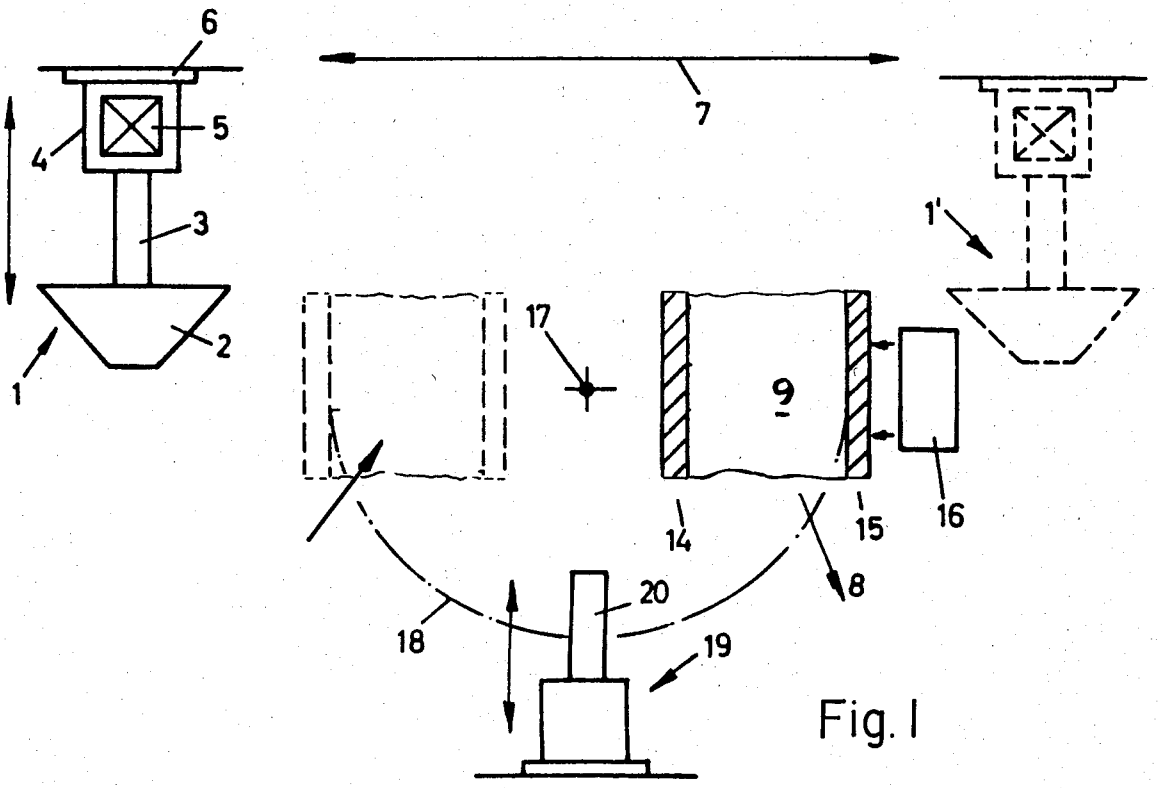
FIG. 1 is a schematic illustration showing the operation mode of the apparatus according to this invention.

In FIG. 1, the cutting unit 1 includes a milling cutter 2 fastened with its shaft 3 to a gripping head 4. Shaft 3, with milling cutter 2, is driven by a driving motor 5. The gripping head 4 for shaft 3 is fastened to a guiding means 6 of the cutting unit, and is movable in the direction of arrow 7 relative to a workpiece support 8, which supports the workpiece 9, preferably a halving joint ledge of T-shaped cross-section. The workpiece 9 is positioned on a clamping device 14, 15. A clamping element 16 generates a clamping pressure against the clamping device. Subsequent thereto, the workpiece support 8 is pivoted around a rotational axis 17 in the direction of broken line 18. When moving in this way, the workpiece 9 engages the grooving unit 19, the grooving tool 20 of which cuts a recess 21 into the workpiece 9, the depth of which recess is half the thickness of the ledge. The grooving unit 19 is adjustable in height within the frame of the machine.

Figure 5:
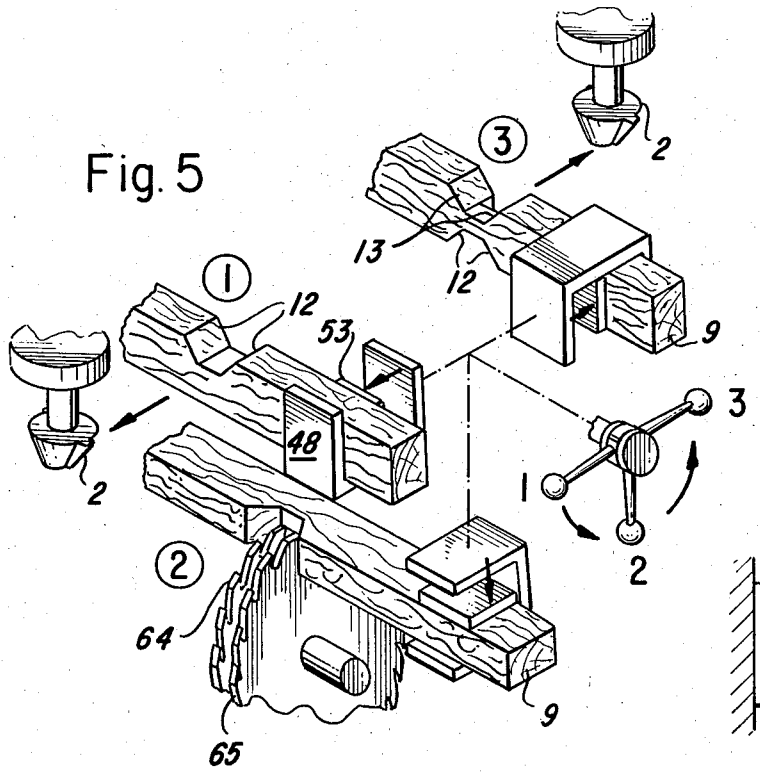
FIG. 5 is a perspective illustration showing the operation of the apparatus according to this invention.

In operation, the cutting unit 1 (FIG. 1) is moved in the direction of arrow 7 to the right and cuts a pair of bevels 12 into the workpiece 9 (ledge) while moving this way. The workpiece is stopped at a position shown by dotted lines at 1'. Subsequently, the workpiece support 8, with workpiece 9, is turned 180° around the rotational axis 17 in the direction of line 18. Having been turned 90°, the workpiece 9 engages the grooving tool 20, which cuts the recess 21. Then, workpiece 9, together with workpiece support 8, is turned another 90° into position 8' and then takes a position 180° displaced from the starting position. In this final position 1' of workpiece 9, the cutting unit 1 is moved from the right to the left (FIG. 1), whereby the cutting tool 2 cuts the second pair of bevels 13. Finally, the cutting unit 1 is again in the starting position at the left side of FIG. 1. Thus, the operation cycle of the apparatus is completed. The finished workpiece 9, with the two opposite pairs of bevels 12, 13 and the groove-like recess 21, is shown in FIG. 5 in a perspective view.

Figure 2:
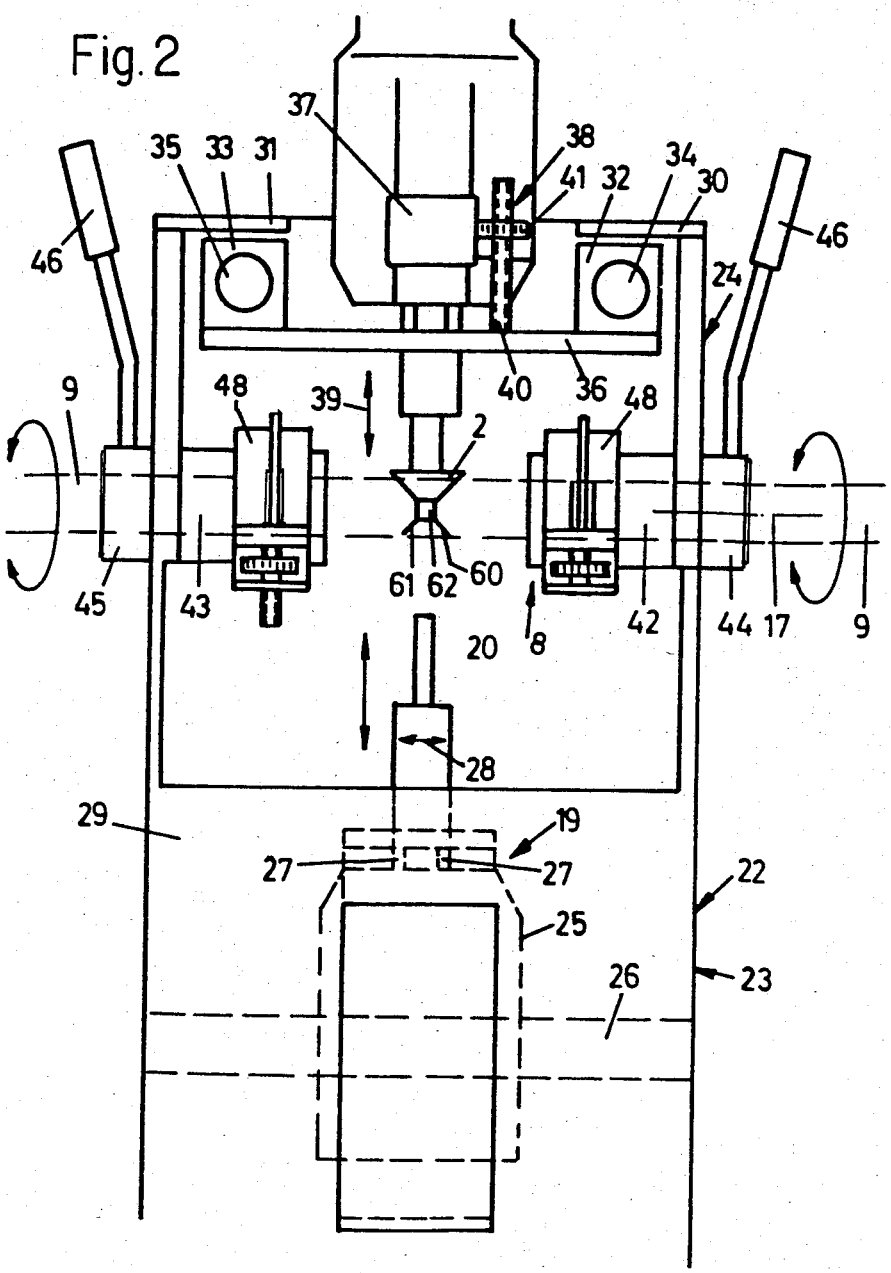
FIG. 2 is a front view of the apparatus according to this invention.
Figure 3:
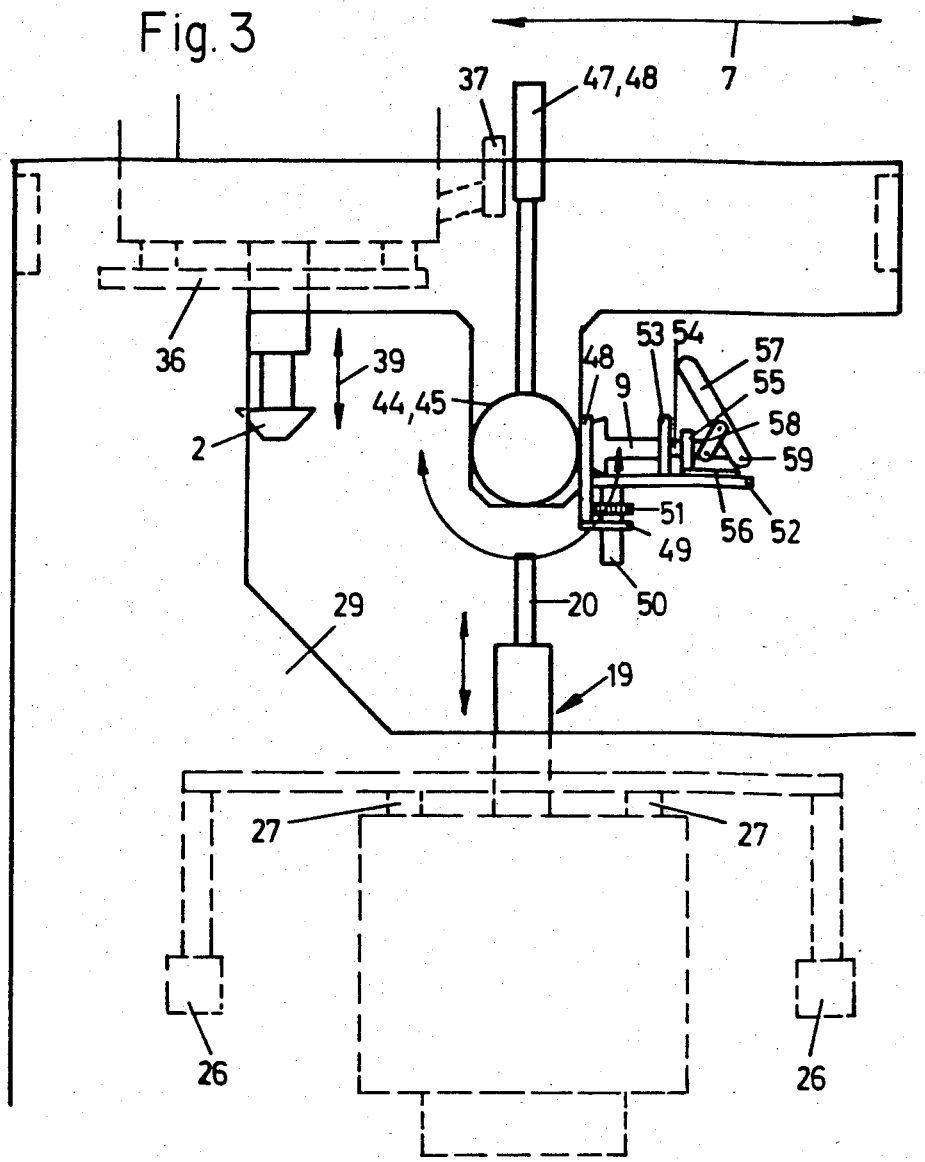
FIG. 3 is a side view of the apparatus.

The structure of the apparatus according to this invention is shown in more detail in FIGS. 2 and 3. The machine frame 22 of the apparatus comprises a lower part 23 carrying the grooving unit 19, and an upper part 24 carrying the cutting unit 1 as well as the workpiece support 8 with workpiece 9. Within the lower part 23 the grooving unit 19, which includes the driving motor for the grooving tool, is fastened to a frame part 25 supported on an intermediate bottom 24 of the machine frame. The adjustment in height of the grooving unit 19 is obtained by height adjusting means 27, 27. The adjustment in height of the grooving tool 20, or alternatively the grooving unit 19, can be made in other ways known in the art. Independent from and in addition to the adjustment of height, the grooving too is laterally adjustable for correcting coordination of the cutting tool to a slight extent, as shown by arrow 28.

The lower part 23 and the upper part 24 of the apparatus are made of vertical and horizontal beams, which are combined into a frame structure, and are embraced by a casing 29, which in the area of the upper part 23 is open laterally and at the front side. On the upper side of the upper part 24, beams 30, 31 are fastened, which carry bearing brackets 32, 33 for guiding rods 34, 35, on which a support plate 36 is movable in the direction of arrow 39 (FIG. 2), which plate holds the cutting unit 1. By means of a handle 37 on the cutting unit 1, said unit 1 and tool 2 are moved by the operator across the entire depth 1—1' of the apparatus. Height adjustment means 38 are mounted to the support plate 36, which means 38 are provided with a screw bolt 40 firmly mounted to the support plate 36 and a thread adjustment wheel 41, which is movable in height on said bolt 40. The movement in height is transmitted to the cutting unit 1. Workpiece support 8 with workpiece 9 is mounted so as to be adjustable in height at the frame structure or alternatively, at the casing 29 and is rotatable around axis 17. Cylindrical rotational elements 44, 45 are supported on studs 42, 43 fixed to the casing; actuating levels 46, 47 are fastened to the outer ends of said rotational elements 44, 45; and workpiece support 8 is connected to said rotational members 44, 45. By means of the actuating levers 46, 47, workpiece support 8 with workpiece 9 is turned around chain-dotted line 18 in FIG. 1. Both rotational elements 44, 45 are identical and take up a support plate 48, which is firmly connected to the corresponding rotational element. The vertical support plate 48 has a horizontal leg 49, through which a bolt 50 passes which engages a threaded adjustment wheel 51. Bolt 50 is connected to a horizontal support plate 52, which takes up a second movable support plate 53. Workpiece 9 is arranged between both support plates 48 and 53. A pusher 54 acts against support plate 53, which pusher is guided within a guide member 55 connected to support plate 52 by means of a flange 56. A lever 57 is mounted to the carrier 52 or alternatively to the flange 56, and is hinged to an intermediate lever 58 pivoted to pusher 54 in such a manner that when actuating lever 57 around the pivot point 49, pusher 54 is urged against the movable support plate 53. Thus, workpiece 9 is positioned between support plate 48 and 53 by clamping pressure. Alternatively, the workpieces also can be clamped pneumatically in a known manner by means of air cylinders. Workpiece support plates 48 and 53 are recessed according to the shape of the cutting tool 2 and at 62 according to the shape of the grooving tool 20 and are divided; they form a protection against splinters from the workpiece.

Figure 4:
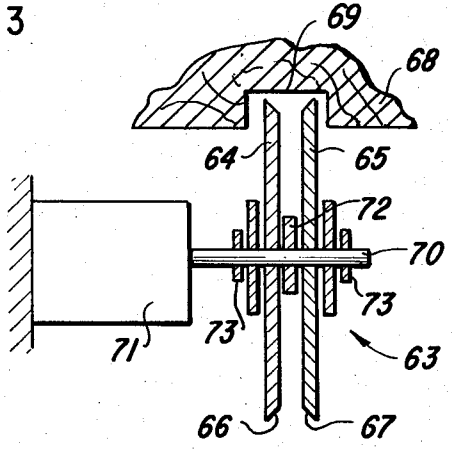
FIG. 4 shows a different embodiment of a grooving tool.

In FIGS. 1-3, the grooving tool 20 is shown schematically as a finger milling cutter. FIG. 4 shows a different embodiment of tool 20, namely a grooving tool 63 comprising preferably two sawblades 64, 65, the peripheral cutting edges 66, 67 of which cut the groove-like recess into the workpiece 68. The width of the recess is varied by changing the number of sawblades, which are arranged parallel and adjacent to each other on shaft 70 of the driving motor 71 and are positioned by means of spacers 72 and clamping rings 73.

What I claim is:

1. A method of cutting pairs of symmetrical bevels on opposite sides of a halving joint of a lattice frame portion, and a groove-like recess between the two opposite pairs of bevels, the recess being cut into a third side of the workpiece connecting the two opposite bevelled sides comprising steps of:

fastening the workpiece to be cut within a clamping device;

cutting bevels on a first side of the workpiece by moving a cutting tool from a starting position in one direction horizontally over and across the workpiece;

turning the workpiece fastened within the clamping device 180° around its longitudinal axis, whereby the recess is automatically cut during this turning movement of the workpiece, as it moves through the operation path of a grooving tool; and returning the cutting tool to its starting position in an opposite direction whereby a pair of bevels is cut in a second side of the workpiece opposite to the first side.

2. An apparatus for cutting pairs of bevels symmetrically arranged about the horizontal axis of a halving joint of a lattice frame portion or similar type of workpiece, and a groove-like recess between the two opposite pairs of bevels, the recess being cut into a third side of the workpiece connecting the two opposite bevelled sides, comprising a frame;

guide means fastened to the frame; a cutting unit supported by said guide means, said cutting unit being horizontally movable across the apparatus and adjustable in height and including means for cutting said bevels;

a stationary tool clamp fastened to the frame for supporting the workpiece under pressure, which clamp positions the workpiece with respect to the tools, and which may be turned 180° around its longitudinal axis in such a manner that in both positions the upper edge of the workpiece has the same height level with respect to the cutting means; and a grooving unit which is fastened to the frame and which supports a grooving tool and a drive motor therefor, which grooving tool is arranged below the workpiece in such a manner that the grooving tool when turning engages the workpiece for cutting the groove.

3. Apparatus according to claim 2, wherein the guide means comprises two parallel guide bars on which the cutting unit is slidably supported.

4. Apparatus according to claim 2, wherein the cutting means is adjustable in height.

5. Apparatus according to claim 2, wherein the workpiece clamp is supported in bearings fastened to the frame, which bearings allow one to turn the workpiece 180° between the two extreme workpiece positions.

6. Apparatus according to claim 2, wherein the workpiece clamp comprises pressure means for positioning the workpiece.

7. Apparatus according to claim 2, wherein the workpiece clamping device is adjustable in height.

8. Apparatus according to claim 2, wherein the grooving unit is adjustable laterally of the longitudinal axis of the workpiece in order to position and adjust the grooving said unit with respect to the unit cutting means.

9. Apparatus according to claim 2, wherein the grooving unit is laterally adjustable relative to the cutting tool, and the this adjustment is a positive adjustment.

* * * * *